US005813668A

United States Patent [19]

Lund

[11] Patent Number: 5,813,668

[45] Date of Patent: Sep. 29, 1998

[54] APPARATUS FOR CONVEYING AND STAGGERING ENVELOPE CONTENTS FOR REVIEW BY AN OPERATOR

[75] Inventor: Bernd Lund, Hamburg, Germany

[73] Assignee: Stielow GmbH & Co., Norderstedt, Germany

[21] Appl. No.: 869,883

[22] Filed: Jun. 5, 1997

Related U.S. Application Data

[63] Continuation of Ser. No. 408,816, Mar. 23, 1995, abandoned.

[30] Foreign Application Priority Data

Mar. 31, 1994 [DE] Germany ..... 44 11 245.9

[51] Int. Cl.[6] ..... B65H 5/00; B65H 29/68

[52] U.S. Cl. ..... 271/2; 271/258.01; 271/265.01; 271/274.275; 271/182; 271/270; 209/539

[58] Field of Search ..... 271/2, 149–151, 271/182, 258.01, 262–263, 265.04, 270, 272–275, 279, 299; 209/539

[56] References Cited

U.S. PATENT DOCUMENTS

| | | | |
|---|---|---|---|
| 490,224 | 7/1990 | Cooper | 271/263 |
| 2,941,653 | 6/1960 | Kriemelmeyer, Jr. | 271/2 X |
| 2,941,654 | 6/1960 | Falconer | 271/2 X |
| 2,988,355 | 6/1961 | Rabinow et al. | 271/2 |
| 3,146,902 | 9/1964 | Voelker | 271/2 X |
| 3,238,926 | 3/1966 | Huck | 53/381.6 |
| 3,726,454 | 4/1973 | Robbins | 53/381.6 |
| 4,016,708 | 4/1977 | DeHart | 53/381.6 |
| 4,123,890 | 11/1978 | Russell et al. | 53/396 |
| 4,233,800 | 11/1980 | Long et al. | 53/381.6 |
| 4,295,321 | 10/1981 | DeHart et al. | 53/381 |
| 4,373,848 | 2/1983 | Bishop | 53/381.6 |
| 4,420,151 | 12/1983 | Kobayashi | 271/274 X |
| 4,626,236 | 12/1986 | Maurer | 53/381.6 |
| 4,815,726 | 3/1989 | Pagowski et al. | 271/274 |

(List continued on next page.)

FOREIGN PATENT DOCUMENTS

| | | | |
|---|---|---|---|
| 0 048 485 | 3/1982 | European Pat. Off. . | |
| 0 279 870 | 2/1987 | European Pat. Off. . | |
| 0 571 308 A1 | 11/1993 | European Pat. Off. . | |
| 209346 | 8/1990 | Japan | 271/182 |
| 2230515 | 10/1990 | United Kingdom | 271/182 |
| 8201698 | 5/1982 | WIPO | 271/263 |
| PCT/US87/02262 | 9/1987 | WIPO . | |
| WO 88/01543 | 3/1988 | WIPO . | |

OTHER PUBLICATIONS

International Publication No. WO 88/01543 (Mar. 10, 1988); International Application No. PCT/US87/02262, Sep. 8, 1987 "Apparatus For The Automated Processing of Bulk Mail and the Like", (Opex Corporation).

Patent Abstracts of Japan, vol. 015, No. 239 (M–1126) Jun. 20, 1991 & JP–A–03 076 665 (Fujitsu Ltd.), Apr. 2, 1991.

*Primary Examiner*—Boris Milef

[57] ABSTRACT

A method and apparatus for conveying and staggering envelope contents includes a driven, substantially vertically positioned conveyor belt with an associated conveying slit, through which the envelope contents including documents to be staggered, are moved past an operator. On the side of the envelope contents opposite the conveyor belt (i.e., facing the operator) there is a non-rotary or slowly rotatable delay roller which can be pressed against the document facing it. The delay roller is preferably moved by an electromagnet. The friction between the delay roller and the document facing it is much greater than the friction between the two envelope contents, so that the front document facing the delay roller is decelerated, while the back document is advanced by the conveyor belt until the two documents are staggered. The operator can then detect whether or not there is a document behind the front document, and whether it is correctly oriented. A second, parallel conveying slit with conveyor belt can be provided behind the first conveying slit for the opened and emptied envelopes.

7 Claims, 2 Drawing Sheets

U.S. PATENT DOCUMENTS

| | | | |
|---|---|---|---|
| 4,863,037 | 9/1989 | Stevens et al. | 209/3.1 |
| 4,866,908 | 9/1989 | Kunne et al. | 53/386 |
| 4,891,088 | 1/1990 | Svyatsky | 271/149 X |
| 4,893,454 | 1/1990 | Russell | 53/492 |
| 4,913,295 | 4/1990 | Murphy et al. | 209/539 X |
| 4,921,388 | 5/1990 | Nelson | 414/412 |
| 4,968,419 | 11/1990 | Karalus et al. | 209/534 |
| 4,973,039 | 11/1990 | Jeske et al. | 271/182 X |
| 5,011,127 | 4/1991 | Hamilton et al. | 271/263 X |
| 5,052,875 | 10/1991 | Miller et al. | 53/381.6 |
| 5,054,700 | 10/1991 | DeWitt | 53/381.3 |
| 5,115,918 | 5/1992 | DeWitt et al. | 209/3.1 |
| 5,156,515 | 10/1992 | Charron et al. | 53/381.3 |
| 5,240,116 | 8/1993 | Stevens et al. | 209/534 |
| 5,443,253 | 8/1995 | Dale et al. | 271/182 X |
| 5,464,099 | 11/1995 | Stevens et al. | 209/3.1 |

APPARATUS FOR CONVEYING AND STAGGERING ENVELOPE CONTENTS FOR REVIEW BY AN OPERATOR

This application is a continuation, of application Ser. No. 08/408,816, filed Mar. 23, 1995, now abandoned.

BACKGROUND OF THE INVENTION

The invention relates to a method and apparatus for conveying and staggering envelope contents, and particularly to a method and apparatus which staggers the contents, so that at least two items of the contents are each at least partially visible to an operator.

There are a number of different types of known apparatus for opening and emptying envelopes. For example, U.S. application Ser. No. 08/323,699 filed Oct. 18, 1994 now U.S. Pat. No. 5,440,861 and based on German Application No. P 42 11885.9 filed Apr. 9, 1992, discloses a system for opening various sized envelopes and for extracting the contents of such envelopes. The goal of such prior art apparatuses is to remove and process the contents of envelopes automatically or at least with minimum personnel requirements. In the case of certain envelope contents, e.g., checks and the payment stubs accompanying the same, problems occur with respect to detection and orientation. The stubs carrying the necessary payment data are normally at the front, because users typically make use of window envelopes. The check associated with a payment stub should be positioned behind the stub and is normally somewhat smaller than the stub, so that after the envelope contents are removed, the check is hidden by the stub and the operator cannot determine whether the check is present, and in particular whether it is correctly oriented.

EP-B-279,857 which corresponds to U.S. Pat. Nos. 4,683,037 and 5,115,919, discloses an apparatus in which two paired documents (e.g., a stub and a check) are separated from one another, so as to allow the two documents to be further processed automatically. Such further processing includes turning or rotating an incorrectly oriented document. In this apparatus, the two documents are completely separated, so that one document is conveyed before the other for further automatic processing.

SUMMARY OF THE INVENTION

The present invention is directed to providing an envelope contents processing method and apparatus which processes the documents in such a way that an operator can view the envelope contents, i.e., the documents, and in particular checks.

According to the present invention, the front envelope document, for example, the stub, is delayed or displaced by a delay roller, so that the presence and orientation of the back envelope document, for example, the check, can be detected. The operator then has the ability to intervene and make corrections by, for example, reorienting the check. The correctly oriented contents can be ejected automatically from a conveying slit. The friction between the delay roller and the front document facing the delay roller is much larger than between the two documents, so that the front document is decelerated, while the rear document is moved forward by the conveyor belt to stagger the contents. The delay time and therefore the displacement length is electronically continuously controllable by a potentiometer. In a preferred embodiment, the delay roller is controlled by an electromagnet with the aid of a sensor.

The apparatus may optionally be constructed with a further conveying slit behind the front conveying slit, for the opened and emptied envelopes. The operator can then additionally determine whether the previously opened and emptied envelopes have been emptied completely.

BRIEF DESCRIPTION OF THE DRAWINGS

These and other objects and advantages of the present invention will become apparent and more readily appreciated from the following description of the preferred embodiments, taken in conjunction with the accompanying drawings, wherein like numerals refer to like parts throughout.

DETAILED DESCRIPTION OF THE PREFERRED EMBODIMENTS

Figure 1:
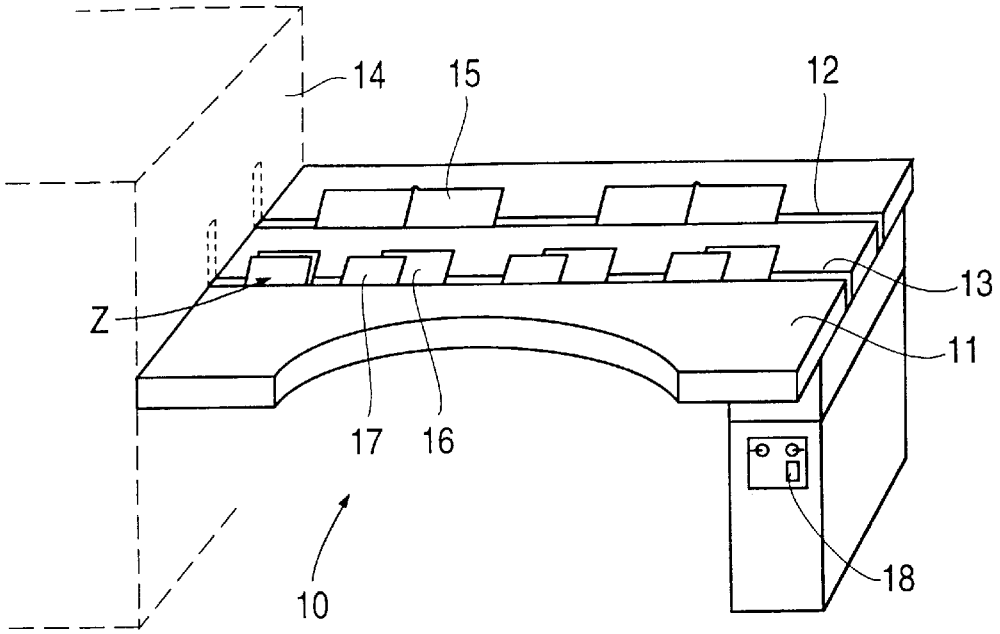
FIG. 1 is a perspective view of an embodiment of an apparatus according to the present invention shown in the form of a work table.

As illustrated in FIG. 1, a work station 10 can be attached to an envelope opening and emptying device 14, such as the apparatus disclosed in U.S. patent application Ser. No. 08/323,699 filed Oct. 18, 1994, now U.S. Pat. No. 5,440,861, the contents of which are incorporated by reference herein.

The work station 10 includes a worktable 11 having conveying slits 12 and 13, with associated stationary conveyor belts 20 and 21 (FIG. 2) positioned below the working surface. The envelopes processed in the upstream envelope opening and emptying device 14 are supplied to the work station 10 as follows.

The front conveying slit 13 facing the operator is provided with documents 16 and 17, which together form envelope contents Z. The second conveying slit 12 which is positioned behind the first conveying slit 13, receives the emptied and opened envelopes 15. A control console 18 for use by the operator, is provided on the work station 10.

With respect to envelope contents 16 and 17, stubs carrying the necessary payment data are normally at the front of the envelope because users typically make use of window envelopes. A check associated with the stub should be positioned behind the stub and is normally somewhat smaller than the stub, so that the operator cannot determine whether a check is present and whether it is correctly oriented because it is hidden by the stub. By delaying the transport of the stub by using a delay roller 23, a portion of the check will be visible to the operator, so that the operator can determine whether a check is present and whether the check is properly oriented. The friction between the delay roller 23 and the front document 17 facing the delay roller 23 is much greater than the friction between the two documents 16 and 17, so that the front document 17 is decelerated, whereas the rear contents 16 is moved froward by the conveyor belt 21. The delay time, and therefore the displacement length, is electronically continuously controlled by a potentiometer but is typically designed to produce a displacement of about 2 inches.

Figure 2:
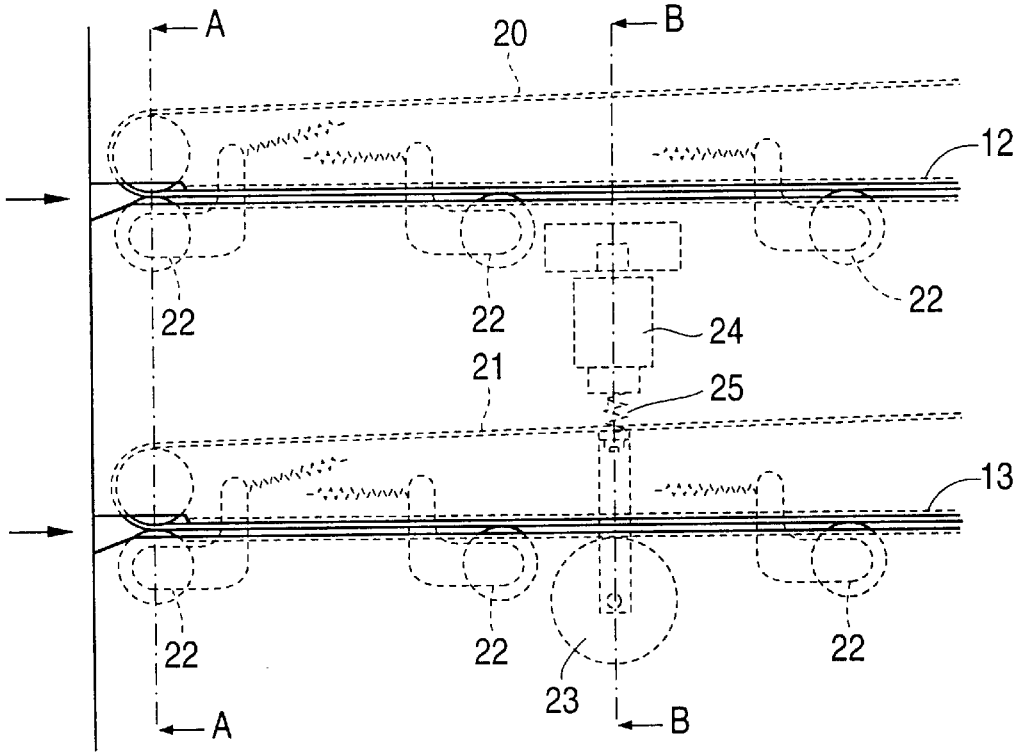
FIG. 2 is an enlarged and detailed plan view of the work table of FIG. 1.
Figure 3:
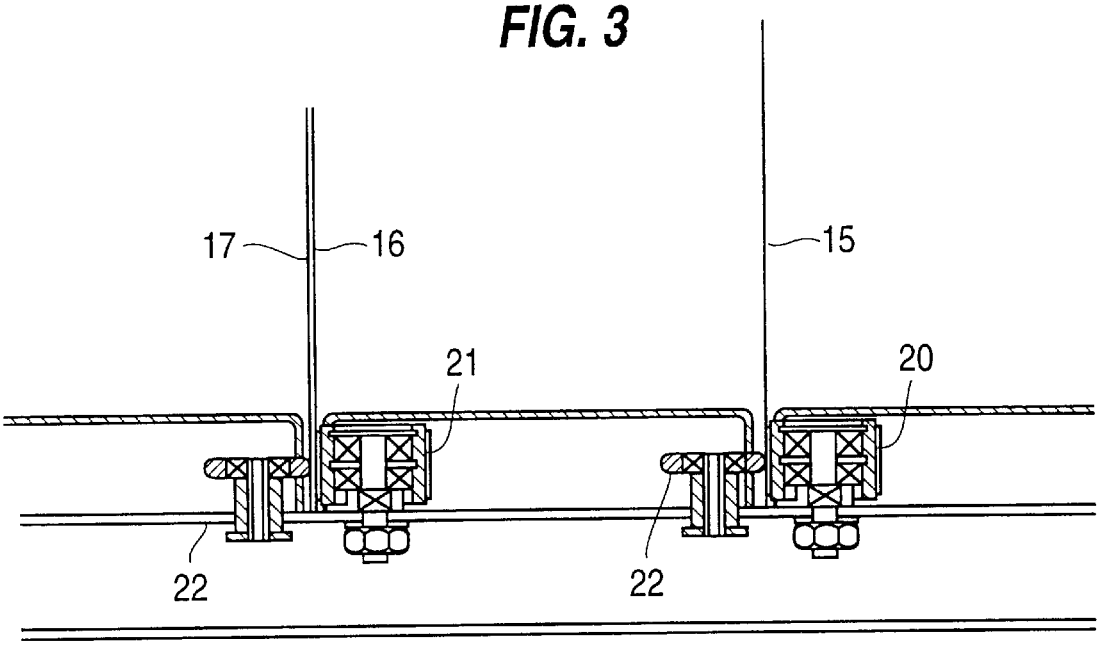
FIG. 3 is a cross-sectional view taken along line A—A of FIG. 2.
Figure 4:
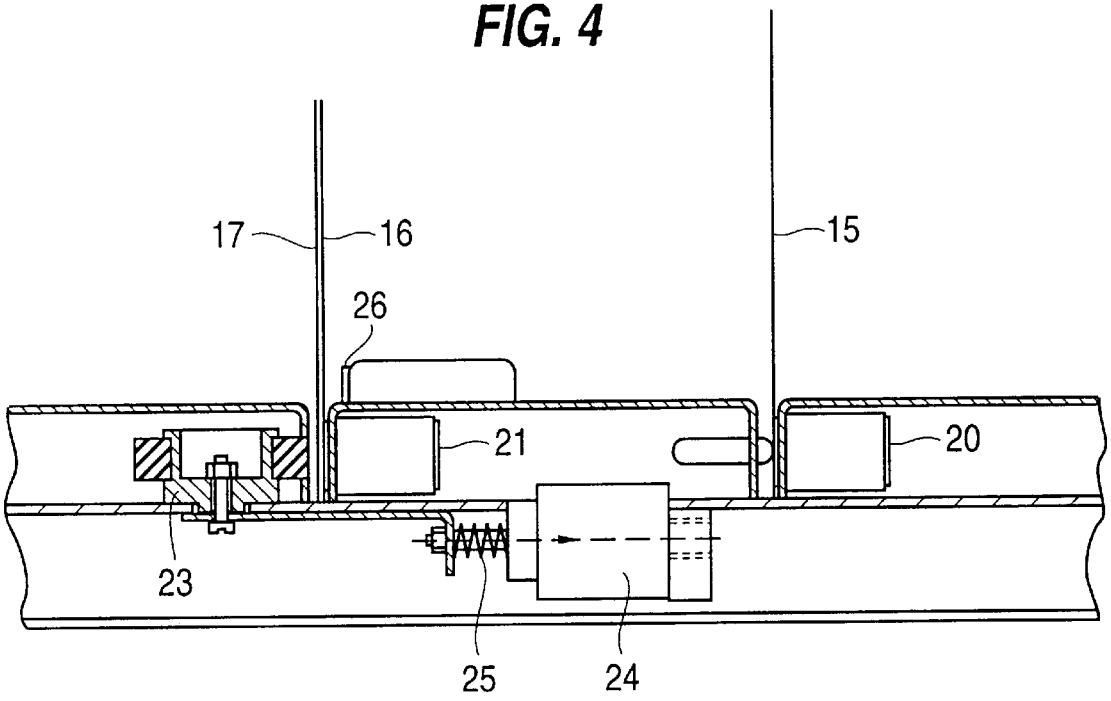
FIG. 4 is a cross-sectional view taken alone line B—B of FIG. 2.

Referring to FIGS. 2–4, the conveying mechanism for the conveying slit 13 is formed by a driven, endless conveyor belt 21 rotating about resiliently and rotatably mounted feed rollers 22 for the envelope contents 16 and 17. The envelope contents 16 and 17 are moved between conveyor belt 21 and feed rollers 22. A delay roller 23, which has little or no rotation, is provided in the movement path of conveying slit 13. An electromagnet 24 is used to press the delay roller 23 against the document 17 closest to the delay roller 23. The electromagnet 24 is biased by a return spring 25. The electromagnet 24, and therefore the actuation time of the delay roller 23, is controlled by a sensor 26 (FIG. 4) positioned along the movement path of the envelope contents 16 and 17.

When the delay roller 23 is pressed against the front document 17 by energizing electromagnet 24, the document 17 is decelerated or stopped from moving, while the document 16 which is behind the document 17, continues to advance so that it can be seen by an operator. This provides the operator with an opportunity to determine whether the check (e.g., document 16) is present and is properly oriented, and to reorient the check if necessary so that the front of the check faces the operator.

On the side of the work station 10 away from the operator position and behind the conveying slit 13, is a second conveying slit 12 with a second conveyor belt 20 and corresponding resiliently rotatably mounted feed rollers 22. This conveyor belt 20 moves the emptied opened envelopes 15 past the operator position, so that the operator can determine whether the envelopes 15 have been completely emptied. The driving speed of the conveyor belt 20 is more than twice that of the conveyor belt 21 because the length of the emptied envelopes 15 is more than twice that of the envelope contents 16 and 17.

Although preferred embodiments of the present invention have been shown and described, it will be appreciated by those skilled in the art that changes may be made in these embodiments without departing from the principles and spirit of the invention, the scope of which is defined by the claims and their equivalents.

What is claimed is:

1. Apparatus for processing envelope contents including overlapping first and second documents, comprising:

a conveyor, including a first conveyor belt, having a path along which the first and second documents move;

a delay apparatus positioned adjacent said conveyor and selectively pressed against one of the first and second documents to stagger the first and second documents so that a portion of each of the first and second documents is visible to an operator even if the first and second documents have the same length; and a second conveyor belt positioned behind said first conveyor belt and forming a second conveying path, wherein said second conveyor belt is substantially parallel to said first conveyor belt and conveys opened and emptied envelopes, so that the opened and emptied envelopes are visible to an operator.

2. Apparatus according to claims 1, wherein said delay apparatus is a delay roller, further comprising an electromagnet for controlling said delay roller to be engaged and disengaged with one of the first and second documents.

3. Apparatus according to claim 2, further comprising a sensor positioned along the path of the first and second documents for controlling said electromagnet.

4. Apparatus according to claim 3, further comprising at least one resiliently and rotatably mounted feed roller for the first and second documents, associated with said conveyor.

5. Apparatus according to claim 2, further comprising at least one resiliently and rotatably mounted feed roller for the first and second documents, associated with said conveyor.

6. Apparatus according to claim 1, further comprising at least one resiliently and rotatably mounted feed roller for the first and second documents, associated with said conveyor.

7. Apparatus according to claim 1, wherein said second conveyor belt for opened envelopes has a driving speed which is more than twice as high as that of said first conveyor belt for the first and second documents.

* * * * *

UNITED STATES PATENT AND TRADEMARK OFFICE

CERTIFICATE OF CORRECTION

PATENT NO.: 5,813,668
DATED : September 29, 1998
INVENTOR(S): Bernd LUND

It is certified that error appears in the above-identified patent and that said Letters Patent is hereby corrected as shown below:

TITLE PAGE: [56] References Cited: Change "490,224" to --4,940,224--, change "Cooper" to --Couper--.

Col. 4, line 17, change "claims" to --claim--.

Signed and Sealed this

Second Day of February, 1999

*Attest:*

*Acting Commissioner of Patents and Trademarks*

*Attesting Officer*